US005957243A

United States Patent [19]

Root et al.

[11] Patent Number: 5,957,243

[45] Date of Patent: Sep. 28, 1999

[54] TANDEM SHEAVE ASSEMBLY, AND METHOD TO INSTALL AN ELEVATOR CAR HAVING A TANDEM SHEAVE

[75] Inventors: Donald C. Root, Bloomington, Ind.; Mario Uttaro, New Britain, Conn.

[73] Assignee: Otis Elevator Company, Farmington, Conn.

[21] Appl. No.: 08/900,612

[22] Filed: Jul. 25, 1997

[51] Int. Cl.[6] ..... B66B 11/08

[52] U.S. Cl. ..... 187/266; 187/414

[58] Field of Search ..... 187/256, 250, 187/266, 345, 414, 343

[56] References Cited

U.S. PATENT DOCUMENTS 4,807,723 2/1989 Salmon et al. ..... 187/266

*Primary Examiner*—Kenneth Noland

[57] ABSTRACT

A tandem sheave assembly for an elevator car includes a hitch plate having an aperture to permit variable positioning of the tandem sheave assembly. A method to install an elevator car includes the steps of: attaching the sheave frame to the car frame via a shaft engaged with the car frame and hitch plate; positioning the sheave frame by rotating the sheave frame about the shaft; and fastening the sheave frame into the desired position by inserting fasteners through the aperture in the hitch plate.

10 Claims, 4 Drawing Sheets

TANDEM SHEAVE ASSEMBLY, AND METHOD TO INSTALL AN ELEVATOR CAR HAVING A TANDEM SHEAVE

TECHNICAL FIELD

The present invention relates to elevators, and more particularly to elevator cars having tandem sheaves.

BACKGROUND OF THE INVENTION

Roped elevator systems use a variety of configurations for the roping. In some applications, a simple 1:1 roping configuration is sufficient. In other applications, a 2:1 roping configuration is used to take advantage of the loads on the ropes being reduced by half with respect to the 1:1 roping, even though the speed of the elevator car is also reduced by half relative to 1:1 roping using the same drive machine characteristics.

The 2:1 roping configuration is achieved by placing one or two sheaves on the car to engage the ropes. If two sheaves are used, they are commonly referred to as tandem sheaves. Tandem sheaves typically comprise a pair of sheaves mounted on a sheave frame. The sheave frame is then mounted under the cross-head of the car frame. Tandem sheaves provide the advantage of accommodating large rope drops (rope center to center distance) that would be impractical with a single sheave.

One drawback to tandem sheaves is the difficulty in aligning the tandem sheaves with the drive sheave and/or the dead-end hitch point. Ideally, the ropes extending upward from the car would form little or no angle relative to vertical. Minimizing this angle improves the performance and operation of the elevator system.

Conventional systems using tandem sheaves incur a considerable amount of cost related to the engineering, manufacture and installation of the tandem sheaves. The sheave frame and cross-head must be engineered to meet the particular angle required by the installation site. Once the angle is determined and the sheave frame and cross-head are fabricated, the sheave frame must be accurately positioned and clamped under the cross-head so that the locations for fastening bolts can be identified and the holes drilled. Even with this preparation, alignment of the ropes at the installation site is difficult due to the inability to manipulate the positioning of the sheave frame and cross-head.

The above art notwithstanding, scientists and engineers under the direction of Applicant's Assignee are working to develop elevator systems that facilitate and minimize the costs associated with fabrication and installation of elevator systems.

DISCLOSURE OF THE INVENTION

According to the present invention, an elevator car includes a tandem sheave assembly and a hitch plate having an aperture to permit variable positioning of the tandem sheave assembly. The feature of variable positioning of the tandem sheave assembly facilitates the installation of the tandem sheave assembly.

During installation, the hitch plate is connected to the car frame in a manner permitting rotation of the hitch plate and tandem sheave assembly. Upon proper positioning of the tandem sheave assembly, one or more fasteners are inserted through the aperture and interconnect the car frame and hitch plate to retain the tandem sheave assembly in the proper position. The ability to easily move the tandem sheave assembly permits accurate alignment of the sheaves and dead-end hitches for the elevator ropes.

In a particular embodiment of the present invention, the elevator car includes a car frame including a cross-beam having an underside, a tandem sheave assembly including a pair of sheaves, and a hitch plate assembly including a hitch plate, a shaft and one or more fasteners. The cross-beam includes a plurality of fixed positions for engagement with the fasteners. The hitch plate includes a plurality of arcuate shaped apertures that are sized to permit passage of the fasteners and flexible locating of the fasteners in the fixed positions. The shaft retains the hitch plate to the cross-beam and defines an axis about which the hitch plate assembly and the tandem sheave assembly may be rotated.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
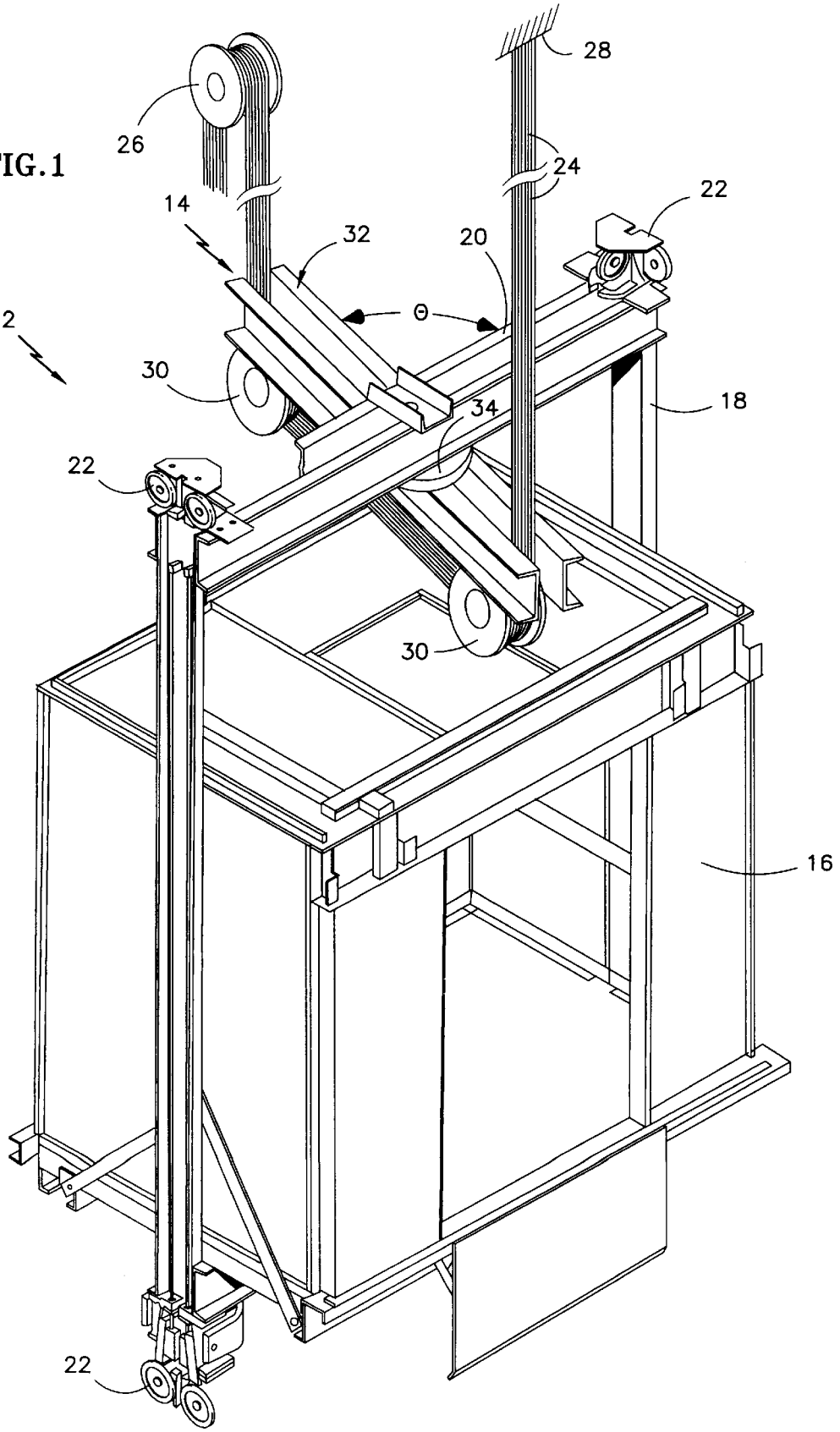
FIG. 1 is perspective view of an elevator car having a tandem sheave assembly.

Illustrated in FIG. 1 is an elevator system 12 having a tandem sheave assembly 14. The elevator system includes a car 16 mounted in a car frame 18. The car frame 18 has four beams, including an upper beam referred to as a cross-head 20 and that is engaged with the tandem sheave assembly 14. The car frame 18 further includes a plurality of guides 22 that are engaged with guide rails (not shown) in a conventional manner to define the travel path of the car frame 18.

The tandem sheave assembly 14 is disposed underneath the underside of the cross-head 20 and is engaged with a plurality of hoist ropes 24. The hoist ropes 24 extend upward from the tandem sheave assembly 14 to a traction sheave 26 and a dead-end hitch 28 disposed above the travel path of the car frame 18. Rotation of the traction sheave 26 changes the length of the ropes 24 between the traction sheave 26 and the dead-end hitch 28, and thereby moves the car frame 18 through its path of travel.

The tandem sheave 14 assembly includes a pair of sheaves 30, a sheave frame 32, and a hitch plate assembly 34. As shown in FIG. 1, the sheave frame 32 is positioned at an angle θ relative to the longitudinal direction of the cross-head 20. The magnitude of the angle θ is determined such that each of the pair of sheaves 30 is aligned with either the traction sheave 26 or the dead-end hitch 28. Aligning the sheaves 26,30 and dead-end hitch 28 in this manner minimizes the angle between the ropes 24 descending from the traction sheave 26 and dead-end hitch 28 and the direction of travel of the car frame 18. Minimizing this angle improves the operability of the elevator system 12.

Figure 2B:
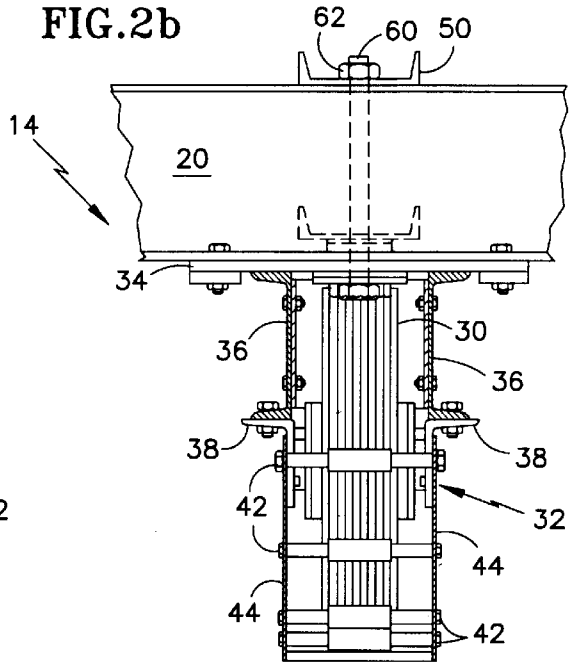
FIGS. 2*a* and 2*b* are sectional views of the tandem sheave assembly and a cross-head.
Figure 2A:
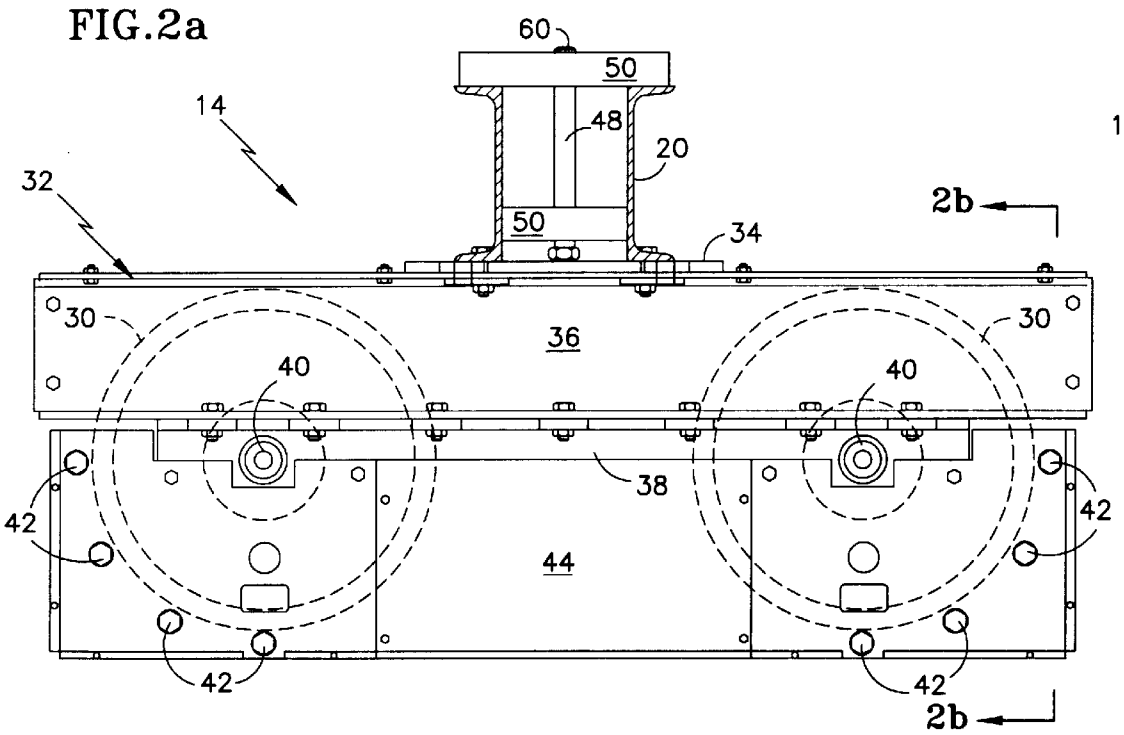

The sheave frame 32 and the pair of sheaves 30 is shown in more detail in FIG. 2*a* and 2*b*. The-sheave frame 32 if formed by bolting together a pair of channels 36 and a pair of angles 38. A shaft 40 for each of the pair of sheaves 30 is mounted in the angles 38. In addition, the sheave frame 32 includes a plurality of rope retainers 42 disposed about the outer periphery of each of the pair of sheaves 30. The rope retainers 42 are mounted in a pair of complementary panels 44 that extend from the angles 38 and function to prevent the ropes 24 from disengaging from the grooves of the sheaves 30 in the event that there is a slackening in the tension in the ropes 24.

Figure 3:
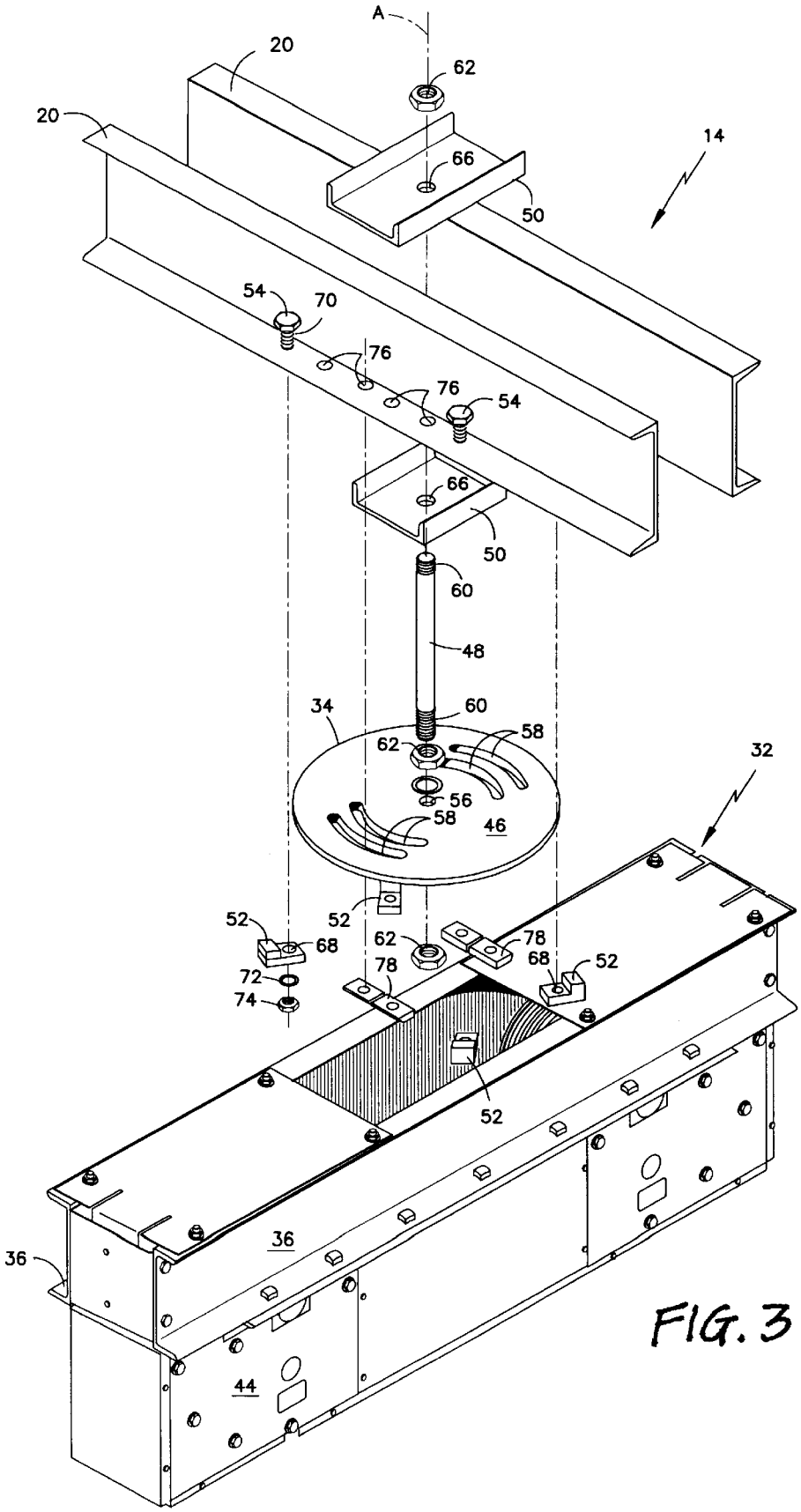
FIG. 3 is an exploded view of a sheave frame, hitch plate assembly and cross-head.

The hitch plate assembly 34 is shown in more detail in FIG. 3. The hitch plate assembly 34 includes a hitch plate 46, a shaft 48, a pair of channels 50, a plurality of clips 52 and a plurality of fasteners 54. The hitch plate 46 is a round, flat plate that is bonded to the sheave frame 32, such as by welding. The hitch plate 46 has a central opening 56 and two pair of opposing, arcuate shaped apertures 58. Each aperture 58 is formed about an arc having a radius originating from the center of the hitch plate 46. In the installed position on the sheave frame 32, each of the apertures 58 is symmetrical about a line extending between the pair of sheaves 30 and passing through the central opening 56.

The shaft 48 has threaded ends 60 and includes threaded nuts 62 engaged with each end 64. The shaft 48 has a diameter that permits the shaft 48 to be inserted through the central opening 56 in the hitch plate 46.

The channels 50 are disposed one above and one between the cross-head channels and include an opening 66 sized to permit passage of the shaft 48 through the openings 66. The channels 50 are secured to the cross-head 20 by welding.

The clips 52 are positioned to engage the outer perimeter of the hitch plate 46 and include an opening 68 to engage the fasteners 54. A portion of the fasteners 54, which include a bolt 70, lock washer 72 and nut 74, pass through openings 76 in the cross-head 20 and engage the clips 52 to clamp the clips 52 to the cross-head 20 such that the hitch plate 46 is retained in a set position relative to the cross-head 20. The remainder of the fasteners 54 pass through openings 76 in the cross-head 20 and the apertures 58 in the hitch plate 46. These fasteners 54 engage a threaded block 78 disposed on the side of the hitch plate 46 opposite to the cross-head 20 to also retain the hitch plate 46 in a set position relative to the cross-head 20.

The combination of the threaded shaft 48 and the fasteners 54, clips 52 and blocks 78 serve the function of retaining the sheave frame 32 in the desired position relative to the cross-head 20. Since the sheave frame 32 is disposed under the cross-head 20, the shaft 48, fasteners 54, clips 52 and blocks 78 are not required to support the load of the elevator car 16. This load is supported by the structure of the sheave frame 32.

The tandem sheave assembly 14 is installed and positioned relative to the cross-head 20 in the following manner. First, the sheave frame 32, including the hitch plate 46 that is bonded to the sheave frame 32, is placed under the cross-head 20. The shaft 48 is then inserted through the openings 56,66 in the channels 50 and the hitch plate 46 and the threaded nuts 60 are engaged with the shaft 48. The nuts 60 are sufficiently engaged with the shaft 48 to retain the sheave frame 32 to the cross-head 20 while permitting rotation of the sheave frame 32 about an axis A defined by the shaft 48. Next, the sheave frame 32 is rotated until each of the pair of sheaves 30 is aligned with the corresponding traction sheave 26 or dead-end hitch 28. Alignment is accomplished using plumb lines or other accepted elevator installation practices. Once aligned, the fasteners 54 are inserted through the openings 76 in the cross-head 20 and hitch plate 46, and then engaged with the clips 52, blocks 78 and nuts 74 to secure the sheave frame 32 into the aligned position. The ropes can then be installed.

Figure 4A:
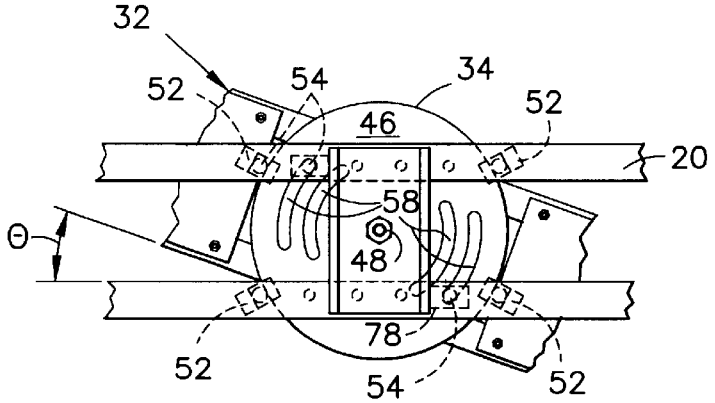
FIGS. 4*a*, 4*b*, and 4*c* are top views of the sheave frame and cross-head in various orientations.
Figure 4B:
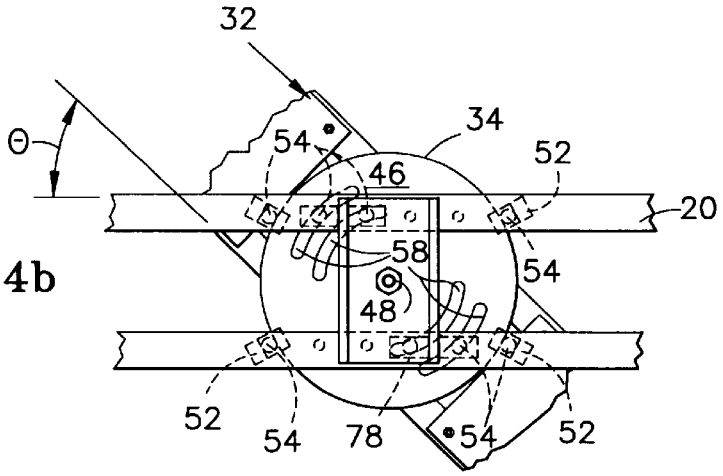
Figure 4C:
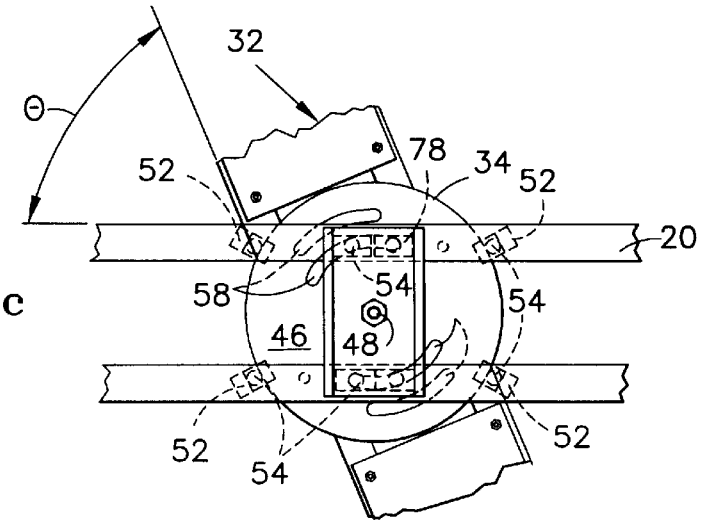

The size and shape of the apertures 58 in the hitch plate 46 permit the sheave frame 32 to be retained in a variety of orientations relative to the cross-head 20, as shown in FIGS. 4*a*, 4*b* and 4*c*. In FIG. 4*a*, the angle θ between the cross-head 20 and the sheave frame 32 is approximately twenty degrees. In this orientation, four fasteners 54 are inserted through clips 52 and two are inserted through the apertures 58 and into blocks 78 to retain the sheave frame 32 into the desired position. In FIG. 4*b*, the angle θ between the cross-head 20 and the sheave frame 32 is approximately forty-five degrees and two fasteners 54 are used with clips 52 and four fasteners 54 are used to insert through the apertures 58 and into blocks 78. In FIG. 4*c*, in which the angle θ approached ninety degrees, four clips 52 and four blocks 78 are engaged with the fasteners 54.

The radial position and shape of the apertures 58 are such that the fasteners 54 may be engaged with two or more of the preset locations for the openings 76 in the cross-head 20. This feature permits the location of the openings 76 to be pre-selected and fixed during fabrication of the sheave frame 32, rather than being custom formed for each individual elevator application. The invention also avoids the step of having to assemble the sheave frame onto the cross-head and align the sheaves and dead-end hitch prior to forming the openings for the fasteners.

Although the configuration of FIGS. 1–4 illustrates the tandem sheave assembly being disposed underneath the cross-head, it should be apparent to those skilled in the art that the invention is equally applicable to configurations having the tandem sheave assembly located underneath the plank or lower beam of the car frame.

Although the invention has been shown and described with respect to exemplary embodiments thereof, it should be understood by those skilled in the art that various changes, omissions, and additions may be made thereto, without departing from the spirit and scope of the invention.

What is claimed is:

1. An elevator car including:

a car frame including a cross-beam, the cross-beam having an underside;

a sheave frame including a pair of sheaves; and a hitch plate assembly including a hitch plate and one or more fasteners, the hitch plate secured to the sheave frame and fastened to the cross-beam by the one or more fasteners to dispose the sheave frame in a fixed manner to the underside of the cross-beam, the hitch plate having an aperture through which the one or more fasteners pass to connect together the underside of the cross-beam and the hitch plate, and wherein the aperture is sized to permit variable positioning of the one or more fasteners such that the relative positioning of the sheave frame to the car frame is adjustable.

2. The elevator car according to claim 1, wherein the car frame includes a plurality of fixed locations for engagement with the one or more fasteners.

3. The elevator-car according to claim 1, wherein the hitch plate assembly further includes a shaft extending through the cross-beam and the hitch plate to retain the cross-beam and hitch plate together, and wherein the shaft defines an axis about which the hitch plate assembly and the sheave frame may be rotated to adjust the relative position of the sheave frame and car frame.

4. The elevator car according to claim 1, wherein the aperture is arcuate shaped.

5. The elevator car according to claim 1, wherein the hitch plate includes a plurality of apertures through which the one or more fasteners may pass to connect the underside of the cross-beam and the hitch plate.

6. The elevator car according to claim 4, wherein the plurality of apertures are arcuate shaped.

7. The elevator car according to claim 3, wherein the hitch plate includes a plurality of apertures through which the one or more fasteners may pass to connect the underside of the cross-beam and the hitch plate, and wherein the plurality of apertures are arcuate shaped about the axis of rotation.

8. The elevator car according to claim 1, wherein the hitch plate is circular, and wherein the hitch plate assembly includes one or more clips that engage the radial outer edge of the hitch plate to clamp the hitch plate to the cross-beam.

9. A method to install an elevator car of an elevator system, the elevator car including a car frame and a tandem sheave, the tandem sheave including a sheave frame, a pair of sheaves, and a hitch plate assembly, the hitch plate assembly including a hitch plate having an aperture, one or more fasteners, and a shaft, including the steps of:

attaching the sheave frame to the car frame by engaging the shaft with the car frame and the hitch plate;

positioning the sheave frame relative to the car frame by rotating the sheave frame about the shaft to the desired position; and fastening the sheave frame into the desired position by inserting the one or more fasteners through the aperture and engaging the one or more fasteners with the car frame and the hitch plate.

10. The method according to claim 9, wherein the elevator system includes one or more ropes that are engaged with the pair of sheaves, the ropes extending from each of the sheaves to either a dead-end hitch point or to a third sheave, and wherein the step of positioning the shave frame includes positioning the sheaves such that each sheave is aligned with either the dead-end hitch point or the third sheave to minimize the vertical angle of the ropes extending from the pair of sheaves.

* * * * *